United States Patent [19]

Sugiura et al.

[11] Patent Number: 4,613,246

[45] Date of Patent: Sep. 23, 1986

[54] PRINTER WITH MOUNTING STRUCTURE FOR PRINT HEAD

[75] Inventors: Toshiro Sugiura; Toshiki Morita; Koichi Takenaka, all of Nagoya, Japan

[73] Assignee: Brother Kogyo Kabushiki Kaisha, Aichi, Japan

[21] Appl. No.: 694,260

[22] Filed: Jan. 24, 1985

[30] Foreign Application Priority Data

Jan. 31, 1984 [JP] Japan ..... 59-12628[U]
Jan. 31, 1984 [JP] Japan ..... 59-12630[U]

[51] Int. Cl.[4] ..... B41J 25/30

[52] U.S. Cl. ..... 400/320; 400/328; 400/124

[58] Field of Search ..... 400/124, 320, 328, 124 IW, 400/124 TC, 124 VI, 124 WD, 322, 120, 175

[56] References Cited

U.S. PATENT DOCUMENTS

| | | | |
|---|---|---|---|
| 3,958,254 | 5/1976 | Okabe | 400/175 X |
| 4,000,393 | 12/1976 | Cochran et al. | 400/120 X |
| 4,229,114 | 10/1980 | Van Horne | 400/124 X |
| 4,239,402 | 12/1980 | Jung et al. | 400/124 X |
| 4,350,448 | 9/1982 | Hanagata et al. | 400/120 |

FOREIGN PATENT DOCUMENTS

| | | | |
|---|---|---|---|
| 55274 | 4/1983 | Japan | 400/320 |

OTHER PUBLICATIONS

IBM Technical Disclosure Bulletin, vol. 26, No. 3B, Aug. 1983, pp. 1578-1579, "Self-Aligning Belt Clamp Mechanism", by Jennings et al.

*Primary Examiner*—Charles A. Pearson
*Attorney, Agent, or Firm*—Parkhurst & Oliff

[57] ABSTRACT

A printer having a print head with a mounting portion, and a carriage with a supporting structure engaging the mounting portion of the print head to hold it in place on the carriage. The supporting structure includes a lateral positioning portion for positioning the print head laterally in a direction of movement of the carriage, a downward positioning portion for positioning the print head downwardly of the carriage, and a rear wall for receiving a force of reaction of the print head upon printing action on a platen. The printer comprises a biasing device for biasing the mounting portion of the print head downwardly and rearwardly against the downward positioning portion and rear wall of the supporting structure of the carriage, respectively. The carriage may include a serrated portion fixedly engaging a toothed belt for driving the carriage along the platen. In this instance, the printer includes a retainer member supported by the carriage to hold a linear section of the belt in engagement with the serrated portion, and hold a flexible cable connected to the print head in pressed contact with the linear section of the toothed belt.

14 Claims, 4 Drawing Figures

PRINTER WITH MOUNTING STRUCTURE FOR PRINT HEAD

BACKGROUND OF THE INVENTION

The present invention relates in general to a printing apparatus having a carriage which is movable along a platen and carries a print head to effect printing along a line parallel to the length of the platen, and more particularly to supporting and mounting structures for mounting the print head in position on the carriage.

In the art of assembling a printer, it has been a common practice to use fasteners such as screws for mounting the print head on the carriage. In this case, the carriage is formed with a protrusion or boss having tapped holes, and the print head has a mounting portion, for example, a pair of flanges extending from its opposite lateral sides. The print head is secured to the carriage by fixing the flanges to the protrusion of the carriage with the screws threaded in the tapped holes. The print head and the carriage have abutting surfaces for accurately positioning the print head relative to the carriage. However, it has been found difficult and cumbersome to mount the print head by way of tightening the fasteners with a suitable tool while holding the print head so as to permit close abutting contact of the positioning surfaces and establish accurate alignment of the print head with the carriage.

SUMMARY OF THE INVENTION

It is therefore an object of the present invention to provide a printer having improved supporting and mounting structures which permit easy mounting of a print head on a carriage with satisfactory accuracy of positioning of the print head in lateral, downward and rearward directions of the carriage.

Another object of the invention is to provide a printer having improved supporting and mounting structures for mounting a print head on a carriage, which permit easy fixation of a carriage drive belt and a flexible print-head cable to an assembly of the carriage and the print head.

According to the present invention, there is provided a printer having a platen for supporting a sheet of paper, a carriage movable along a length of the platen, and a print head carried by the carriage to print characters on the sheet of paper along a line of printing parallel to the length of the platen, wherein the improvement comprises: (a) a supporting structure provided on the carriage, including a lateral positioning portion for positioning the print head laterally of the carriage in a direction of movement thereof along the line of printing, a downward positioning portion for positioning the print head downwardly of the carriage, and a rear wall for receiving a force of reaction of the print head upon printing action thereof on the platen; (b) a mounting portion of the print head engageable with the supporting structure of the carriage for mounting the print head in position on the carriage; and (c) biasing means for biasing the mounting portion of the print head downwardly and rearwardly against the downward positioning portion and the rear wall of the supporting structure of the carriage, respectively.

For easy understanding of the invention, the terms "rear", "rearward", "rearwardly", "downward", and "downwardly" are used in the present application, in connection with the supporting structure of the carriage and the mounting portion of the print head, since the platen and carriage of the instant printer are usually disposed in the horizontal plane, and the print head is generally biased in the rearward and downward directions by the biasing means. However, the horizontal arrangement of the platen and carriage is not an essential element of the present invention. Therefore, it is to be understood that the terms "rear", "rearward" and "rearwardly" are construed to mean a direction away from the platen toward the print head in a plane normal to the length of the platen, and that the terms "downward" and "downwardly" are construed to mean a direction normal to the length of the platen and to the "rearward" direction.

In one advantageous embodiment of the invention, the biasing means comprises a sheet spring which biases the mounting portion of the print head with a biasing force consisting of a first component with which the mounting portion is biased against the rear wall, and a second component with which the mounting portion is biased against the downward positioning portion.

According to one form of the above embodiment, the mounting portion of the print head has a rear surface contacting the rear wall of the supporting structure of the carriage, and a front surface substantially parallel to said rear surface, and the sheet spring includes a body portion which contacts an upper edge and a lower portion of the front surface of the mounting portion of the print head, but is spaced from an intermediate portion of the front surface between the upper edge and the lower portion, and a bent upper end portion bent from an upper edge of the body portion rearwardly toward the rear wall of the supporting structure. The supporting structure includes a first bearing section which contacts an intermediate part of the body portion of the sheet spring and holds the intermediate part in its biasing position in the proximity of the front surface of the mounting portion, to produce said first component of the biasing force of the sheet spring. The supporting structure further includes a second bearing section which contacts a rear end of the bent upper end portion of the sheet spring and holds the rear end thereof in its biasing position, to produce said second component of the biasing force of the sheet spring.

In an advantageous arrangement of the above form of the invention, the mounting portion comprises a pair of ears protruding from opposite sides of the print head in opposite directions in the direction of movement of the carriage. Each of the ears is engaged by said sheet spring, and the supporting structure includes a pair of guide grooves slidably engageable with the pair of ears to guide the ears vertically in a direction toward the downward positioning portion. The supporting structure further includes a pair of detent tabs engaging the bent upper end portion of the sheet spring. The body portion of the sheet spring and the ears of the print head are inserted in the guide grooves downwardly toward the downward positioning portion of the supporting structure. The rear edge of the bent upper end portion engages the pair of detent tabs, respectively, while the print head is held in abutting contact with the downward positioning portion of the supporting structure. The supporting structure has front walls partially defining the guide grooves. The front walls constitute said first bearing section, and said detent tabs constitute said second bearing section.

According to another aspect of the invention, there is provided a printer having a platen for supporting a sheet of paper, a carriage movable along a length of the platen, a print head carried by the carriage to print characters on the sheet of paper along a line of printing parallel to the length of the platen, and a flexible cable connected to the print head to apply printing signals thereto, wherein the improvement comprises: (a) an endless toothed belt disposed so as to include a linear section movable along the line of printing to drive the carriage, the toothed belt having teeth on an inner surface thereof; and (b) a serrated portion formed on the carriage and fixedly engaging the teeth of the toothed belt; (c) and a retainer member supported by the carriage to hold the linear section of the toothed belt with its teeth in engagement with the serrated portion of the carriage, the flexible cable being interposed between the retainer member and the linear section of the toothed belt, whereby the flexible cable and the toothed belt are held between the carriage and the retainer member.

According to one embodiment of the above aspect of the invention, the carriage includes at least one pair of opposed projections which are spaced from each other in a direction perpendicular to the direction of movement of said carriage so as to define a gap therebetween. This gap is selected to be greater than a thickness of said toothed belt but smaller than a width of the toothed belt. The retainer member is forced by said at least one pair of opposed projections toward the serrated portion of the carriage.

In the above embodiment, the retainer member is inserted between the toothed belt and said at least one pair of opposed projections. The retainer member comprises a stopper portion abutting on the carriage to limit a distance of insertion of the retainer member, and a resilient latching hook engaging the carriage to lock the retainer member in position while the retainer member is inserted with the stopper portion abutting on the carriage. The latching member is elastically deformable in sliding contact with the carriage when the retainer member is inserted.

In one form of the above embodiment, the carriage includes a first and a second side wall, extending upright from lateral opposite ends thereof, respectively, and said at least one pair of opposed projections comprise a first pair of opposed projections formed on the first side wall, and a second pair of opposed projections formed on the second side wall.

In an advantageous arrangement of the above form of the invention, the retainer member comprises an elongate portion extending along the linear section of the toothed belt. This elongate portion includes a pair of notches formed in a portion thereof corresponding to the second side wall while the elongate portion is placed in a first position thereof at which a first end of the elongate portion is located inwardly of the first side wall. The pair of notches permits the second pair of opposed projections to pass therethrough. The elongate portion is placed in said first position with the second pair of opposed projections having passed the pair of notches, and the elongate portion is moved from said first position to a second position thereof at which said first end thereof is inserted between the linear section of the toothed belt and the first pair of opposed projections while the portion thereof adjacent to the pair of notches is inserted between the linear section of the toothed belt and the second pair of opposed notches. Preferably, the retainer member includes a presser boss for forcing part of the linear section of the toothed belt into a central recess formed in the serrated portion of the carriage. In this case, the presser boss is adapted to be located opposite to the central recess while the elongate member is placed in any positions between said first and second positions thereof.

In another embodiment of this aspect of the invention, the serrated portion is formed in the upper surface of the carriage, and the carriage includes a cable guide portion of inverted-L shape having a horizontal section extending substantially horizontally rearwardly from the serrated portion, and a vertical section extending downwardly from a rear end of the horizontal section. The retainer member includes a cable retaining portion of inverted-L shape which cooperates with the cable guide portion of the carriage to sandwich the flexible cable therebetween. The cable retaining portion having a horizontal and a vertical section substantially parallel to said horizontal and vertical sections of the carriage, respectively.

The vertical section of the cable retaining portion of the retainer member may include a biasing piece which is fixed at its lower end. The biasing piece is elastically deformed with its free end in pressed contact with the flexible cable, and thus biases the flexible cable against the vertical section of the cable guide portion of the carriage while the retainer member is placed in position.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
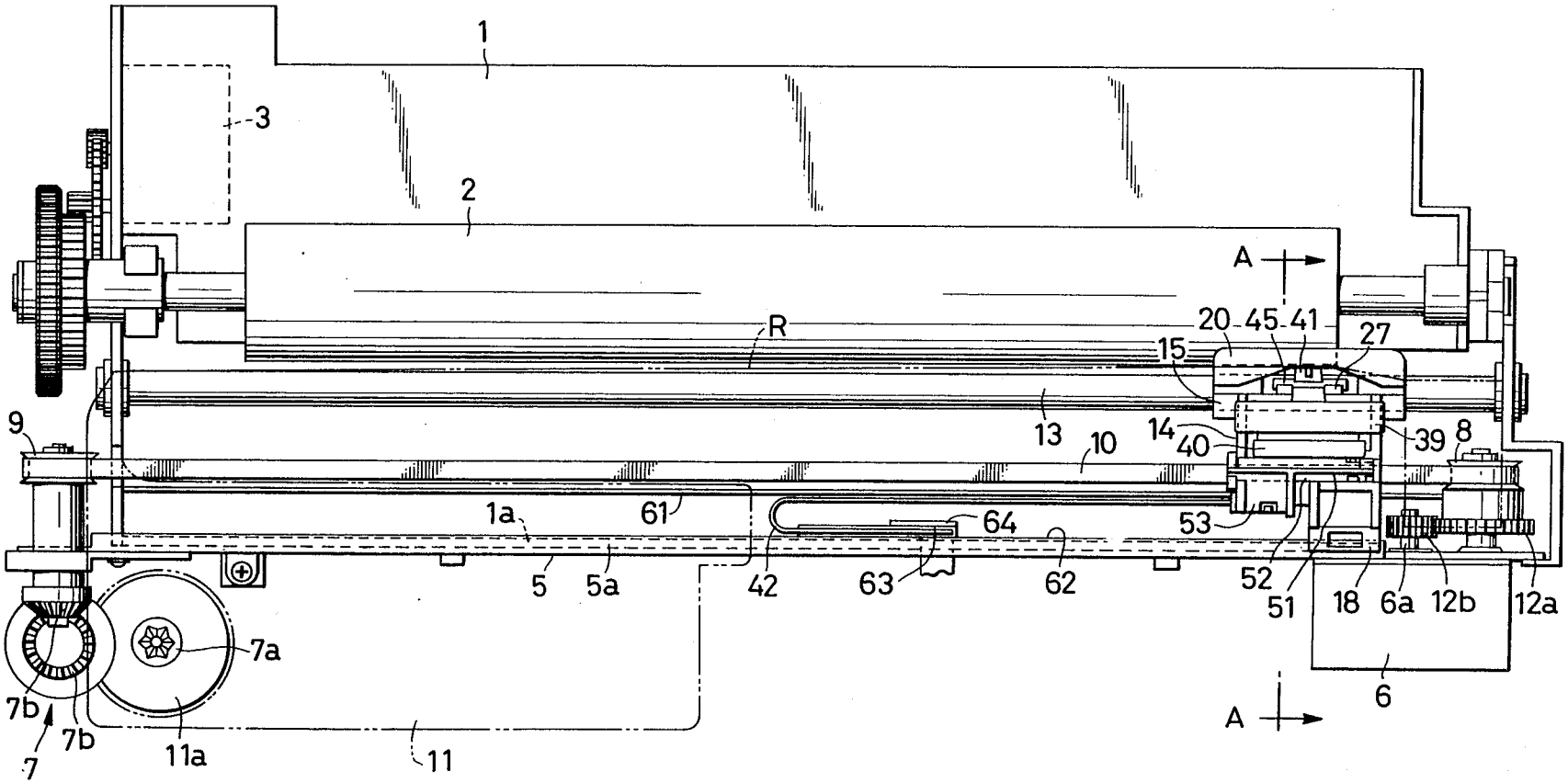
FIG. 1 is a plan view of one embodiment of a printer of the present invention.

Referring now to the drawing, the invention will be more fully described in its preferred embodiment.

There is shown in FIG. 1 a printer which has a platen 2 rotatably supported in a relatively rear portion of a frame 1 so as to extend longitudinally of the frame 1. The platen 2 is rotated by a platen drive motor 3. The frame 1 has a front wall 1*a* in front of the platen 2. To the front surface of the front wall 1*a*, there is attached a front plate 5 of metal having a turned upper end 5*a*, as shown also in FIGS. 2 and 3. A carriage drive motor 6 is mounted on the front of a right-hand side end portion of the front plate 5 (as seen in FIG. 1), and a ribbon feed mechanism 7 is attached to the front of a left-hand side end of the front plate 5. The ribbon feed mechanism 7 include plural gears 7*b*.

A geared driving pulley 8 is disposed behind the carriage driving motor 6 while a geared driven pulley 9 is disposed behind the ribbon feed mechanism 7. The driven pulley 9 is connected to the driving pulley 8 by an endless toothed belt 10 having teeth 10*a* on its inner surface of the loop. The driving pulley 8 is connected to a drive shaft 6a of the motor 6 via gears 12a, 12b, so that an upper linear section 10b of the toothed belt 10 is moved between the driving and driven pulleys 8, 9 in opposite directions along the length of the platen 2, i.e., along the line of printing of the printer, when the carriage drive motor 6 is operated in corresponding opposite directions. A ribbon cassette 11 is disposed such that a ribbon feed roll 11a is coupled to a drive shaft 7a of the ribbon feed mechanism 7, so that the ribbon feed roll 11a is rotated during rotation of the driven pulley 9. With the rotation of the ribbon feed roll 11a, a ribbon R is fed from the cassette 11 and a length of the ribbon R is moved in front of the platen 2 along the line of printing.

Between the platen 1 and the front wall 1a and in the proximity of the platen 1, there is supported on the frame 1 a guide rod 13 extending parallel to the platen 2. The guide rod 13 supports a carriage 14 slidably at its cylinder portion 15 at the front lower part, so that the carriage 14 is movable along the length of the platen 2. For convenience, the end of the carriage 14 including the cylinder portion 15 on the side of the platen 2 is referred to as "front" end, and the corresponding end of a print head 39 (which will be described) is referred to as "front" end. Thus, in connection with the carriage 14 and the print head 39, the side thereof adjacent to the platen 2 is called the front side. Accordingly, the front and rear sides of the carriage 14 and the print head 39 are reversed with respect to those of the printer (frame 1) when viewed as a whole.

Figure 2:
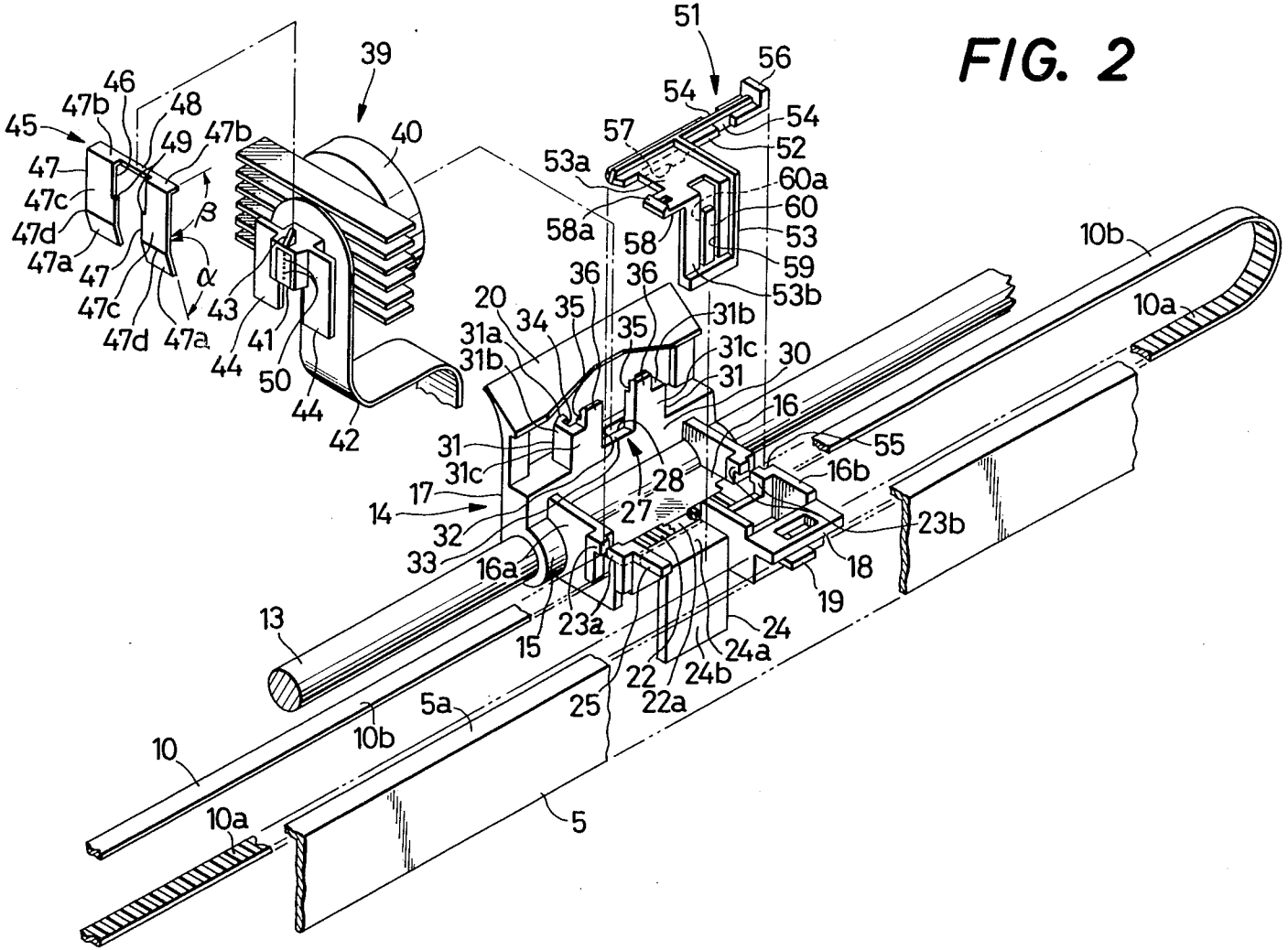
FIG. 2 is a fragmentary exploded view in perspective of the printer of FIG. 1.
Figure 3:
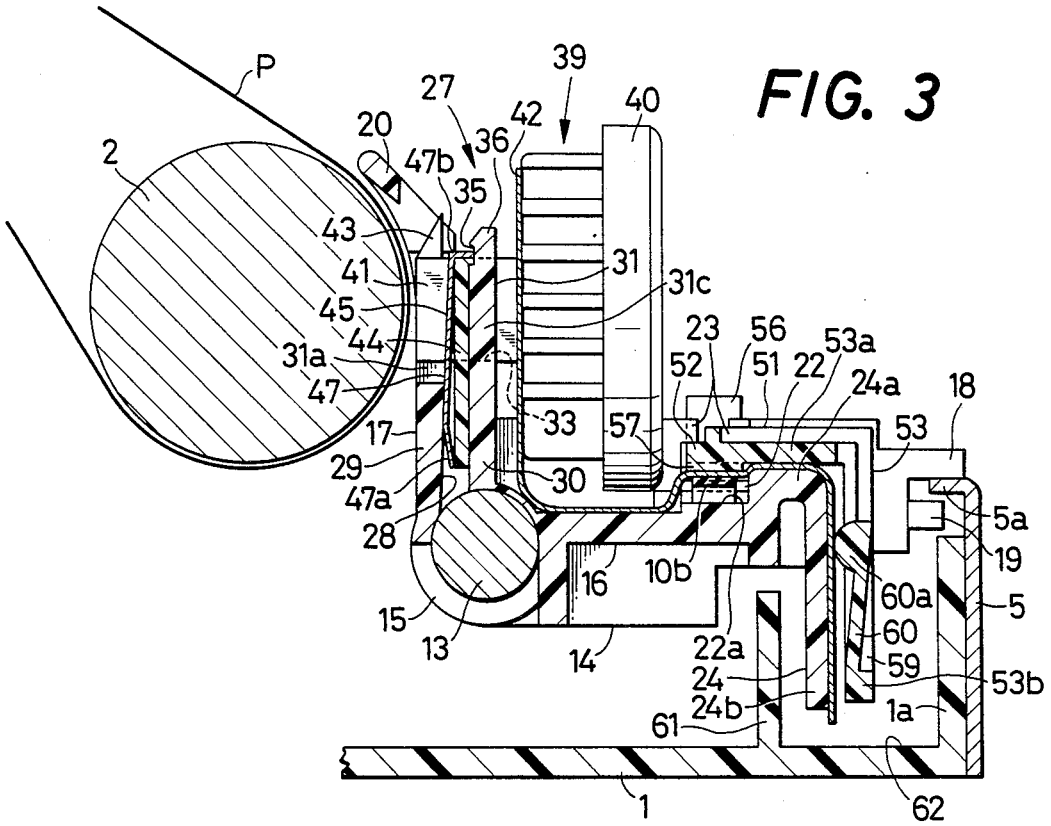
FIG. 3 is an enlarged elevational view in cross section taken on line A—A of FIG. 1, showing a print head, a carriage-drive belt, and a flexible cable, which are mounted or fixed in position on a carriage.

As shown in FIGS. 2 and 3, the carriage 14 includes a substantially horizontal base portion 16 extending substantially perpendicular to the direction of movement thereof, and an upright portion 17 extending substantially vertically from the front end of the base portion 16. The base and upright portions 16, 17 are formed integrally of a suitable synthetic resin material. As will be described in detail, the linear section 10a of the toothed belt 10 is secured to the carriage 14 so as to lie across the base portion 16. The base portion 16 is provided, at its right-hand side rear end, with a bearing portion 18 which is slidable on the upper surface of the turned upper end 5a of the metallic front plate 5 in order to maintain the carriage 14 (precisely, its base portion 16) in the horizontal position, and further provided with a lug 19 disposed below the turned upper end 5a in order to prevent the bearing portion 18 from being lifted upward away from the upper surface of the turned upper end 5a.

A serrated portion 22 is integrally formed in the upper surface of the base portion 16 of the carriage 14, so that the serrated portion 22 extends transversely of the base portion 16, that is, in parallel to the guide rod 13. The serrated portion 22 engages the teeth 10a of the upper linear section 10b of the toothed belt 10. In the middle of the serrated portion 22, there is formed a central recess 22a. The base portion 16 includes a first side wall 16a, and a second side wall 16b, which side walls 16a, 16b extend upright from lateral opposite ends of the base portion 16, respectively. The first and second pairs of side walls 16a and 16b are formed with respective first and second pairs of opposed projections 23a and 23b which are located above the respective opposite ends of the serrated portion 22. Each pair of opposed projections 23a, 23b are spaced from each other in a direction perpendicular to the length of the serrated portion 22 (the upper linear section 10b of the belt 10), i.e., perpendicular to the line of printing, so as to define a gap therebetween. This gap is selected to be greater than a thickness of the toothed belt 10 but smaller than a width of the belt 10. In other words, the upper linear section 10b of the toothed belt 10 may pass through the gap between the opposed projections 23a, 23b when the upper and lower (inner and outer) surfaces of the linear section 10b are held upright, but do not permit the linear section 10b to pass through the gap when the surfaces of the linear section 10b are oriented horizontally, i.e., held in the normal operating position.

At the left-hand side rear end of the base portion 16 of the carriage 14, there is formed a cable guide portion 24 of inverted L-shape which consists of a horizontal section 24a extending substantially horizontally and rearwardly from the serrated portion 22, and a vertical section 24b extending downwardly from a rear end of the horizontal section 24a. The upper surface of the horizontal section 24a is higher in level than the top surface of the serrated portion 22. Spaced upwardly by a suitable distance from the upper surface of the horizontal section 24a of the cable guide portion 24, there is formed a latching piece 25 which protrudes rearwardly from the rear end of the first side wall 16a of the base portion 16. The function of this latching piece 25 will be described later.

Figure 4:
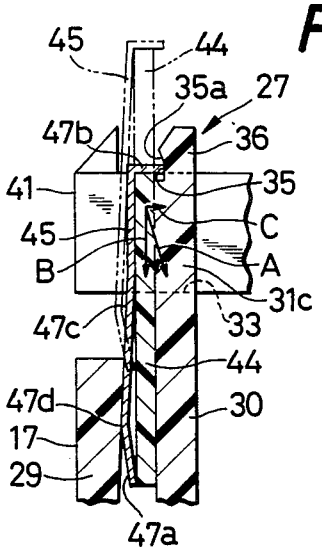
FIG. 4 is a fragmentary elevational cross sectional view in enlargement, showing a biasing member in position associated with a supporting structure of the carriage and a mounting portion of the print head.

The upright portion 17 of the carriage 14 serves as a major part of a supporting structure generally indicated at 27, which structure 27 provides the mount for the print head 39. The supporting structure 27 includes portions defining an engagement slot 28 which is formed in the longitudinally central part of the upright portion 17 such that the slot 28 is parallel to the platen 2. The thickness of the engagement slot 28 is defined by a front wall 29 and a rear wall 30 as indicated in FIG. 3. The supporting structure 27 further has a pair of projections 31 which protrude from the top of the upright portion 17. The projections 31 are spaced from each other in the direction of width of the engagement slot 28, that is, in the direction parallel to the guide rod 13, so that a rectangular notch 32 is defined by the projections 31 and a top surface 33 of the upright projection 17. Each of the two projections 31 includes a front wall 31a, a side wall 31b and a rear wall 31c, which cooperate to define a guide groove 34. The guide grooves 34 defined by the pair of projections 31 are aligned with the engagement slot 28. Stated more particularly, the front and rear walls 31a and 31c serve as extensions of the front and rear walls 29 and 30 of the upright portion 17, respectively, so that the guide grooves 34 terminate in the engagement slot 28. The width of the rectangular notch 32 is defined by the opposite inner ends of the rear walls 31c of the projections 31. The rear walls 31c are provided, on their upper ends, with detent tabs 36 each of which has a recess 35, and a slant surface 35a partially defining the recess 35, as most clearly shown in FIG. 4.

As described later in greater detail, the side walls 31b serve as a lateral positioning portion of the supporting structure 27 for positioning the print head 39 laterally of the carriage 14 in a direction of movement thereof parallel to the platen 2, and the top surface 33 of the upright portion 17 serves as a downward positioning portion of the supporting structure 27 for positioning the print head 39 downwardly of the carriage 14. Further, the rear wall 30 of the upright portion 17 and the rear walls 31c of the projections 31 serve to receive a force of reaction of the print head 39 upon the printing action on the platen 2.

The print head 39 mounted on the supporting structure 27 of the carriage 14 is a dot-matrix print head including a nose 41 for guiding printing wires 50 (FIG. 2) toward and away from a sheet of paper P (FIG. 3) supported on the platen 2, and a wire drive 40 for selectively actuating the printing wires 50. The print head 39 further includes a flexible cable 42 of generally ribbon-like configuration connected to the wire drive 40 to apply printing signals necessary to operate the print head 39 for printing. The print head 39 has a pointer 43 of triangular shape carried on the top of the nose 41, and a pair of planar rectangular mounting ears 44 which protrude from opposide sides of the nose 41 in opposite directions along the length of the platen 2. The mounting ears 44 extend downwardly in parallel to each other by a distance considerably greater than the height of the nose. Upon mounting of the print head 39 on the carriage 14, these rectangular mounting ears 44 which serve as a mounting portion of the print head 39, are inserted into the engagement slot 28 while being guided by the guide grooves 34 in sliding engagement until the bottom of the nose 41 abuts on the top surface 33 of the upright portion 17 which acts as the downward positioning meas for the print head 39. As previously indicated, the side walls 31*b* of the pair of projections 31 are adapted to serve as means for positioning the print head 39 in the lateral direction along the length of the platen 2.

Each of the planar rectangular mounting ears 44 is provided with a biasing member in the form of a sheet spring 45 formed from a metal spring sheet. The sheet spring 45 comprises a pair of parallel arms 47 each having a rearwardly turned lower portion 47*a*, a rearwardly bent upper end portion 47*b*, and an intermediate portion 47*c* between the portions 47*a* and 47*b*. The intermediate portion 47*c* and the lower portion 47*a* constitute a body portion of the biasing member for each mounting ear 44. The two arms 47 are integrally connected to each other at their bent upper end portions 47*b* by a connecting portion 48, so that a cutout 46 is defined by the arms 47 and the connecting portion 48. The arms 47 have shoulders 49 at their inner central parts. The sheet spring 45 is mounted on the nose 41 such that the outer periphery of the nose 41 is in engagement with the inner peripheries of the arms 47 and the connecting portion 48 defining the cutout 46 and the shoulders 49. The connecting portion 48 engages the pointer 43 to prevent the sheet spring 45 from moving frontward relative to the nose 41, and the shoulders 49 engage the lower surface of the nose 41 to prevent the sheet spring 45 from moving upward relative to the nose 41.

In the present embodiment, the angle $\alpha$ of the turned lower portions 47*a* of the arms 47 with respect to the intermediate portions 47*c* is selected to be about 170 degrees, and the angle $\beta$ of the bent upper end portions 47*b* to the intermediate portions 47*c* is selected to be about 93 degrees. With the print head 39 mounted in position on the carriage 14 as shown in FIG. 3, the intermediate portions 47*c* and turned lower portions 47*a* are interposed between and in pressed contact with the front walls 29, 31*a* and the front surfaces of the rectangular mounting ears 44, and the rear edge of the bent upper end portions 47*b* are held in pressed contact with the tapered surfaces 35*a* of the detent tabs 35. Described in greater detail, the upper edge of the intermediate portion 47*c* contacts the upper edge of the ear 44, while the turned lower portion 47*a* contacts a lower portion of the front surface of the ear 44. In the meantime, the front wall 29 of the upright portion 17 contacts an intermediate part 47*d* (lower part of the portion 47*c* and upper part of the portion 47*a*) of the arm 47 of the sheet spring 45 and holds the intermediate part 47*d* in its biasing position in the proximity of the front surface of the ear 44, thereby biasing the ear 44 against the rear walls 30, 31*c*. Further, the bent upper end portion 47*b* is forced by the detent tab 35 against the upper end of the ear 44, thereby biasing the ear 44 downward and forcing the lower surface of the nose 41 in pressed contact with the top surface 33 of the upright portion 17.

For fixing the toothed belt 10 and the flexible cable 42 to the carriage 14, there is provided a retainer member 51 as depicted in FIG. 2, which is formed of synthetic resin. The retainer member 51 comprises a generally elongate belt-retaining portion 52 having a width substantially equal to that of the serrated portion 22 of the carriage 14. The retainer member 51 further comprises a cable-retaining portion 53 of inverted-L shape which is disposed along the inverted-L shape of the cable guide portion 24 of the carriage 14. The belt-retaining portion 52 is provided, at its right end, with a stopper portion 56 which protrudes upward and is adapted to engage a recess 55 formed in the second side wall 16*b* of the carriage 14. The belt-retaining portion 52 has a pair of notches 54 which are spaced from the stopper portion 56 by a suitable distance, so that the notches 54 are located at a position corresponding to the second side wall 16*b* while the retainer member 51 is placed in its first position at which the left end of the elongate belt-retaining portion 52 is located inwardly of the first side wall 16*a*. These notches 54 are formed so that the second pair of opposed projections 23*b* may pass through the notches 54 when the retainer member 51 is installed in position. This position is referred to as the second position. The belt-retaining portion 52 is further provided with a presser boss 57, which protrudes from a longitudinally middle part of the lower surface of the portion 52. With the retainer member 51 installed in the second position in a manner which will be described later, the left surface of the stopper portion 56 is held in abutting contact with the opposed projections 23*b* on the second side wall 16*b*, and the presser boss 57 is aligned with the central recess 22*a* formed in the serrated portion 22 of the carriage 14. In this condition, the upper surface of the belt-retaining portion 52 contacts the lower sides of the first and second pairs of projections 23*a*, 23*b* on the first and second side walls 16*a*, 16*b*, whereby the upward movement of the belt-retaining portion 52 is prevented by the projections 23*a*, 23*b*. As shown in FIG. 3, the linear section 10*b* of the belt 10 and the flexible cable 42 are sandwiched between the belt-retaining portion 52 and the serrated portion 22 with the presser boss 57 in pressed contact with the flexible cable 42.

The cable-retaining portion 53 includes a horizontal section 53*a* opposite to the horizontal section 24*a* of the cable guide portion 24 of the carriage 14, and a vertical section 53*b* opposite to the vertical section 24*b* of the cable guide portion 24. The horizontal section 53*a* has a resilient tongue 58 extending from the rear portion of its left side. This tongue 58 has a latching hook 58*a* at its end. When the retainer member 51 is installed, the tongue 58 is moved with elastic deformation in sliding contact with the lower surface of the previously indicated latching piece 25, and the latching hook 58*a* eventually engages the latching piece 25 to prevent the retainer member 51 from moving rightward. The vertical section 53*b* of the cable-retaining portion 53 is formed with an integral elongate biasing piece 60 which is defined by a cutout 59 so that the biasing piece 60 is fixed only at its lower end. As shown in FIG. 3, the biasing piece 60 has a presser protuberance 60*a* at its free end. When the retainer member 51 is installed, the flexible cable 42 is sandwiched between the horizontal section 24*a* of the cable guide portion 24 and the horizontal section 53*a* of the cable-retaining portion 53, and pressed against the vertical section 24*b* of the cable guide portion 24 by the presser protuberance 60*a* of the biasing piece 60 of the vertical section 53*b* of the cable-retaining portion 53.

With the foregoing arrangements of the carriage 14, print head 39, sheet spring 45 and retainer member 51, the print head 39, toothed belt 10 and flexible cable 42 are mounted on or secured to the carriage 14, so that desired characters are printed on the sheet of paper P on the platen 2 by the print head 39 while the carriage 14 is reciprocated along the platen 2 by the drive motor 6 via the endless belt 10, according to the printing signals fed to the print head 39 through the flexible cable 42.

The front wall 1*a* and a partition wall 61 spaced from the front wall 1*a* define a cable chamber 62, as shown in FIG. 3. The flexible cable 42, which is secured to the carriage 14, is arranged to extend into the cable chamber 62. As shown in FIG. 1, the leading end of the cable 42 is led out of the frame 1 through an opening 63 formed in the central part of the bottom of the cable chamber 62. The cable 42 is held in its vertical position by a cable retainer 64 disposed adjacent to the opening 63.

There will be described in detail the procedure by which the carriage 10, print head 39, belt 10 and flexible cable 42 are assembled.

At first, the carriage 14 is supported at its front cylinder portion 15 by the guide rod 13, and at its rear bearing portion 18 by the turned upper end 5*a* of the front plate 5, as shown in FIG. 2. Then, the print head 39 is mounted on the carriage 14. To mount the print head 39, the sheet spring 45 is first attached to the nose 41 such that the rectangular mounting ears 44 are covered by the pair of arms 47. Then, the mounting ears 44 with the sheet spring 45 are inserted into the engagement slot 28 while being guided by the guide grooves 34, until the lower surface of the nose 41 rests on the top surface 33 of the upright portion 17. The rectangular ears 44 are positioned laterally of the carriage 14 by the side walls 31*b* of the protrusions 31, and the vertical position of the print head 39 is maintained by the abutting contact of the nose 41 with the top surface 33. In this condition, the front wall 29 of the upright portion 17 contacts the intermediate parts 47*d* of the arms 47 and thereby hold these intermediate parts 47*d* in the deformed, biasing position in close proximity of the front surface of the rectangular mounting ears 44 of the print head 39, thereby enabling the sheet spring 45 to rearwardly bias the mounting ears 44 against the rear wall 30 of the upright portion 17 and against the rear walls 31*c* of the projections 31. In addition, the bent upper end portions 47*b* of the sheet spring 45 are held in pressed engagement with the tapered surfaces 35*a* of the detent tabs 36 of the projections 31, whereby the nose 41 is downwardly biased against the top surface 33 of the upright portion 17. Stated more particularly referring to FIG. 4 wherein broken lines indicate the natural shape of the arm 47 having the turned lower portion 47*a* and bent upper end portion 47*b*, the insertion of the sheet spring 45 causes elastic deformation of flexture of the arm 47 as indicated in solid lines. In this position (biasing position), the biasing force A of the sheet spring 45 produced by the elastic deformation consists of a first component C with which the mounting ears 44 are biased against the rear walls 30, 31*c*, and a second component B with which the nose 41 is biased against the top surface 33 of the upright portion 17. The reaction forces of these first and second components C and B are received by the front wall 29, and the tapered surfaces 35*a* of the detent tabs 36. In other words, the front wall 29 serves as a first bearing section of the supporting structure 27 which enables the sheet spring 45 to produce the first component C of its biasing force A, and the detent tabs 36 serve as a second bearing section of the supporting structure 27 which enables the sheet spring 45 to produce the second component B.

As described hereinbefore, the mere insertion of the mounting ears 44 of the print head 39 together with the sheet spring 45 into the engagement slot 28 and the guide grooves 34 results in simultaneous accurate positioning of the print head 39 in its lateral, rearward and downward directions, as well as permits rigid mounting of the print head 39 on the carriage 14. In particular, the foregoing arrangements maintain close pressed contact of the rear surface of the ears 44 with the front surfaces of the rear walls 30, 31*c* of the supporting structure 27, which permits the print head 39 to withstand a force of reaction upon impact of the printing wires 50 on the platen 2 during printing, thus eliminating rattling movements of the mounting ears 44 relative to the supporting structure 27, which would cause imperfect impression of characters on the sheet of paper P.

The toothed belt 10 and the flexible cable 42 are connected or secured to the carriage 14 in the following manner. At first, the upper linear section 10*b* of the belt 10 is oriented so that the outer and inner surfaces are placed in the vertical plane. In this position, the linear section 10*b* is moved down between the two pairs of opposed projections 23*a*, 23*b*. Then, the teeth 10*a* on the inner surface of the linear section 10*b* are engaged with the serrated portion 22 of the carriage 14. Successively, the flexible cable 42 from the print head 39 is positioned to extend over the linear section 10*b* of the belt 10, and along the surfaces of the cable guide portion 24 of inverted-L shape. The flexible cable 42 is then led into the cable chamber 62, in which the cable 42 is turned around, as shown in FIG. 1, so that the leading end is led outside of the frame 1 through the opening 63.

Subsequently, the retainer member 51 is positioned so that its notches 54 of the elongate belt-retaining portion 52 are aligned with the second pair of opposed projections 23*b* on the second side wall 16*b* of the carriage 14. In this condition, the retainer member 51 is moved down so that the belt-retaining portion 52 lies on a portion of the flexible cable 42 which overlies the upper linear section 10*b* of the belt 10 engaging the serrated portion 22. From this position (first position as previously indicated), the retainer member 51 is moved to the left to its second position (previously indicated) along the length of the serrated portion 22 until the stopper portion 56 abuts on the right sides of the opposed projections 23*b* which partially define the recess 55, whereby the retainer member 51 is positioned in the leftward direction. In the process of movement of the retainer member 51 to its second position (operating position), the resilient tongue 58 of the cable-retaining portion 53 slidably contacts the latching piece 25, and is elastically deformed. The latching hook 58*a* at the end of the tongue 58 engages the latching piece 25 when the stopper portion 56 has abutted on the opposed projections 23*b* on the second side wall 16*b*. Thus, the retainer member 51 is locked by the latching hook 58*a* and the stopper portion 56 in the lateral directions. In this state, the opposite end portions of the belt-retaining portion 52 are urged downward in pressed contact with the lower surfaces of the two pairs of opposed projections 23*a*, 23*b*, whereby the upper linear section 10*b* of the belt 10 and the flexible cable 42 are pressed between the belt-retaining portion 52 and the serrated portion 22 of the carriage 14. In this condition, the presser boss 57 forces corresponding parts of the linear section 10*b* and the cable 42 toward the central recess 22*a*. Thus, the installation of the retainer member 51 results in the fixation of the toothed belt 10 and the flexible cable 42 to the carriage 14, in such manner that prevents displacements of the linear belt section 10*b* relative to the carriage 14 in its direction of movements, and displacements of the flexible cable 42 relative to the carriage 14 in the direction perpendicular to the direction of movements of the carriage 14.

Further, by installing the retainer member 51 in position on the carriage 14, the flexible cable 42 is sandwiched between the cable guide portion 24 of the carriage 14 and the cable-retaining portion 53 of the retainer member 51. In addition, the flexible cable 42 is pressed against the surface of the vertical section 24*b* of the cable guide portion 24 by the presser protuberance 60*a* of the biasing piece 60 of the vertical section 53*b* of the cable-retaining portion 53.

As described hereinabove, the toothed belt 10 and the flexible cable 42 may be firmly fixed to the carriage 14 as a result of the mere installation of the retainer member 51 in an easy quick action, without any fasteners which are conventionally used in the art, and without the use of any tools to tighten such fasteners. Thus, the number of parts of the pritner is reduced, and the assembling efficiency is accordingly increased.

While the present invention has been described in its preferred embodiment, it is to be understood that the invention is not confined to the precise details of the illustrated embodiment, and that changes and modifications may be made herein which do not affect the spirit of the invention nor exceed the scope thereof as expressed in the appended claims. For example, the sheet spring 45 used in the illustrated embodiment may be supported by the supporting structure 27 of the carriage 14 before the print head 39 is mounted. Further, it is possible to form a biasing member (e.g. in the form of a sheet spring) integrally with the mounting ears 44 of the print head 39, or with the supporting structure 27 of the carriage 14. It is also possible to change the configurations of the lateral, downward and rearward positioning arrangements of the supporting structure 27 of the carriage 14.

What is claimed is:

1. A printer having a platen for supporting a sheet of paper, a carriage movable along a length of the platen, a print head carried by the carriage to print characters on the sheet of paper along a line of printing parallel to the length of the platen, and a flexible cable connected to said print head to apply printing signals thereto, comprising:

an endless toothed belt disposed so as to include a linear section movable along said line of printing to drive said carriage, said toothed belt having teeth on an inner surface thereof; and a serrated portion formed on said carriage and fixedly engaging said teeth of said toothed belt; and a retainer member supported by said carriage to hold said linear section of the toothed belt with its teeth in engagement with said serrated portion of the carriage, said flexible cable being interposed between said retainer member and said linear section of said toothed belt, whereby said flexible cable and said toothed belt are held between said carriage and said retainer member, said carriage including at least one pair of opposed projections which are spaced from each other in a direction perpendicular to the direction of movement of said carriage so as to define a gap therebetween, said gap being greater than a thickness of said toothed belt but smaller than a width of the toothed belt, said retainer member being forced by said at least one pair of opposed projections toward said serrated portion of the carriage.

2. The printer of claim 1, wherein said retainer member is inserted between said toothed belt and said at least one pair of opposed projections, said retainer member comprising a stopper portion abutting on said carriage to limit a distance of insertion of the retainer member, and a resilient latching hook engaging said carriage to lock the retainer member in position while the retainer member is inserted with said stopper portion abutting on the carriage, said latching member being elastically deformable in sliding contact with the carriage when the retainer member is inserted.

3. The printer of claim 1, wherein said carriage includes a first and a second side wall, extending upright from lateral opposite ends thereof, respectively, said at least one pair of opposed projections comprising a first pair of opposed projections formed on said first side wall, and a second pair of opposed projections formed on said second side wall.

4. The printer of claim 3, wherein said serrated portion of the carriage has a central recess, and said retainer member includes a presser boss for forcing a part of said toothed belt into said central recess.

5. The printer of claim 4, wherein said retainer member comprises an elongate portion extending along said linear section of the toothed belt, said elongate portion including a pair of notches formed in a portion thereof corresponding to said second side wall while said elongate portion is placed in a first position thereof at which a first end of the elongate portion is located inwardly of said first side wall, said pair of notches permitting said second pair of opposed projections to pass therethrough, said elongate portion being placed in said first position with said second pair of opposed projections having passed said pair of notches, said elongate portion being moved from said first position to a second position thereof at which said first end thereof is inserted between said linear section of the toothed belt and said first pair of opposed projections while the portion thereof adjacent to said pair of notches is inserted between said linear section of the toothed belt and said second pair of opposed notches, said presser boss being located opposite to said central recess while said elongate portion is placed in any positions between said first and second positions.

6. The printer of claim 5, wherein said elongate portion includes a stopper portion abutting on said second pair of opposed projections to limit a distance of insertion of the elongate portion from said first position to said second position, and said retainer member further comprises a resilient latching hook engaging said carriage to lock the elongate portion in said second position, said latching member being elastically deformable in sliding contact with said carriage.

7. The printer of claim 1, wherein said serrated portion is formed in the upper surface of said carriage, and said carriage includes a cable guide portion of inverted-L shape having a horizontal section extending substantially horizontally rearwardly from said serrated portion, and a vertical section extending downwardly from a rear end of said horizontal section, said retainer member including a cable retaining portion of inverted-L shape which cooperates with said cable guide portion of the carriage to sandwich said flexible cable therebetween, said cable retaining portion having a horizontal and a vertical section substantially parallel to said horizontal and vertical sections of said carriage, respectively.

8. The printer of claim 7, wherein an upper surface of said horizontal section of said cable guide portion of the carriage is higher in level than a top surface of said serrated portion of the carriage.

9. The printer of claim 7, wherein said vertical section of said cable retaining portion of the retainer member includes a biasing piece which is fixed at a lower end thereof to the vertical section of the cable retaining portion, said biasing piece being elastically deformed with a free end thereof in pressed contact with said flexible cable and biasing the flexible cable against said vertical section of said cable guide portion while said retainer member is placed in position.

10. A printer having a platen for supporting a sheet of paper, a carriage movable along a length of the platen, and a print head carried by the carriage to print characters on the sheet of paper along a line of printing parallel to the length of the platen, comprising:

a supporting structure provided on said carriage, including a lateral positioning portion for positioning said print head laterally of said carriage in a direction of movement thereof along said line of printing, a first bearing section, a downward positioning portion having a second bearing section for positioning said print head downwardly of said carriage, and a rear wall for receiving a force of reaction of said print head upon printing action thereof on said platen;

a mounting portion of said print head engageable with said supporting structure of said carriage for mounting said print head in position on said carriage, said mounting portion having a rear surface contacting said rear wall of the supporting structure, and a front surface substantially parallel to said rear surface; and a sheet spring for biasing said mounting portion of the print head rearwardly and downwardly against said rear wall and said downward positioning portion of said supporting structure, with a first and a second component of a biasing force, respectively, said sheet spring including a body portion which contacts an upper edge and a lower portion of said front surface of the mounting portion but is spaced at an intermediate part thereof from an intermediate portion of said front surface between said upper edge and said lower portion, and a bent upper end portion bent from an upper edge of said body portion rearwardly toward said rear wall of the supporting structure, said first bearing section of said supporting structure contacting said intermediate part of said body portion of the sheet spring and holding said intermediate part in its biasing position in the proximity of said front surface of said mounting portion, to produce said first component of the biasing force of the sheet spring, said second bearing section of the supporting structure contacting a rear end of said bent upper end portion of the sheet spring and holding said rear end thereof in its biasing position, to produce said second component of said biasing force.

11. The printer of claim 10, wherein said mounting portion comprises a pair of ears protruding from opposite sides of said print head in opposite directions in said direction of movement of said carriage, each of said ears being engaged by said sheet spring, said supporting structure including a pair of guide grooves slidably engageable with said pair of ears to guide the ears vertically in a direction toward said downward positioning portion, and further including a pair of detent tabs engaging the bent upper end portion of said sheet spring, the body portion of said sheet spring being inserted together with said ears in said guide grooves downwardly toward said downward positioning portion of the supporting structure, the rear edge of said bent upper end portion engaging said pair of detent tabs, while said print head is held in abutting contact with said downward positioning portion, said supporting structure having front walls partially defining said guide grooves, said front walls constituting said first bearing section, and said detent tabs constituting said second bearing section.

12. The printer of claim 11, wherein said sheet spring includes two generally parallel arms which are connected integrally to each other at their upper portions by a connecting portion, such that the arms of the sheet spring are disposed opposite to said ears.

13. The printer of claim 12, wherein said arms of said sheet spring have shoulders on their opposite inner edges, said shoulders engaging a lower surface of said print head and thereby preventing an upward movement of the sheet spring relative to said print head.

14. The printer of claim 11, wherein said print head is a dot-matrix print head including a nose for guiding printing wires toward and away from said platen, and a wire drive for selectively actuating said printing wires, said ears extending from opposite sides of said nose.

* * * * *